US007487931B2

(12) United States Patent
Monyak

(10) Patent No.: US 7,487,931 B2
(45) Date of Patent: Feb. 10, 2009

(54) SHINGLE PROCESSING TOOL AND METHOD

(75) Inventor: Kenneth Monyak, Abingdon, VA (US)

(73) Assignee: Sandvik Intellectual Property AB, Sandviken (SE)

( * ) Notice: Subject to any disclaimer, the term of this patent is extended or adjusted under 35 U.S.C. 154(b) by 415 days.

(21) Appl. No.: 10/897,128

(22) Filed: Jul. 23, 2004

(65) Prior Publication Data

US 2006/0016304 A1 Jan. 26, 2006

(51) Int. Cl.
*B02C 13/00* (2006.01)

(52) U.S. Cl. ..... 241/197; 241/294; 241/300; 299/108; 299/39.8

(58) Field of Classification Search ..... 241/300, 241/294, 197; 144/218, 233, 241, 231, 235; 299/112 R, 112 T, 108, 39.8; 83/840, 844, 83/839, 834, 831, 841, 845, 853, 830
See application file for complete search history.

(56) References Cited

U.S. PATENT DOCUMENTS 2,539,962 A * 1/1951 Mavor ..... 299/32
3,834,764 A * 9/1974 Krekeler ..... 299/108
4,143,920 A * 3/1979 Haddock ..... 299/112 R
4,462,638 A * 7/1984 DenBesten et al. ..... 299/108
4,607,891 A * 8/1986 Pendolino et al. ..... 299/108
4,903,609 A * 2/1990 Isakov et al. ..... 104/10
5,941,469 A 8/1999 Spiegemacher
5,950,945 A 9/1999 Schaller
6,176,332 B1 * 1/2001 Massa et al. ..... 175/420.1
6,322,012 B1 11/2001 Päper
6,435,434 B1 8/2002 Monyak

* cited by examiner

*Primary Examiner*—Bena Miller
(74) *Attorney, Agent, or Firm*—Drinker Biddle & Reath LLP

(57) ABSTRACT

A cutting tool for attachment to the leading area of a base is provided. The cutting tool includes a holder base having two substantially parallel cutting teeth extending from the holder base, the cutting teeth each having a cutting edge and an opening between the teeth. The cutting teeth define first and second cutting paths. The cutting teeth impact and cut asphalt shingles, and funneling surfaces of the teeth funnel the cut shingle material toward and through the opening, and into the path of the rear cutting member which cuts the material a second time. Thus, asphalt shingles are processed more efficiently, thereby creating less frictional heat and avoiding melting of the asphalt shingles.

14 Claims, 2 Drawing Sheets

SHINGLE PROCESSING TOOL AND METHOD

FIELD OF THE INVENTION

The present invention relates generally to material processors and to methods of processing material, such as asphalt shingles.

BACKGROUND OF THE INVENTION

It is well known in the art that adding a mixture of 4-10% recycled asphalt shingle by-product to road pavement enhances the pavement's stability, reduces cracking of the pavement, and increases the pavement's durability. Therefore, a demand exists for such by-products of recycled asphalt shingles and it is desirable to efficiently and economically grind asphalt shingles into byproduct for use in road pavement.

It has been previously known in the art to use wood-grinding apparatus to grind asphalt shingles. A wood grinding apparatus generally employs a large rotating drum with grinding heads attached to the outside of the drum. The drum is located inside an outer container having a screened portion. The screened portion allows wood chips to exit through the screen once they are small enough.

The wood grinding heads comprise a body for attachment to the outside of the rotating drum and a grinding tool that attaches to the body. As the drum rotates, the grinding heads also rotate and wood material is fed into the screened container and toward the rotating drum. As the material contacts the rotating grinding heads, the material is ground into by-product. This by-product continues to cycle around the inside of the screened container and be ground until the by-product's diameter is small enough to exit through the screened portion.

These wood-grinding apparatus work well grinding wood, but when grinding asphalt shingles they create excessive frictional heat that melts the shingles, thereby hindering the grinding and causing significant damage to the apparatus, as explained below.

A popular wood-grinding head used to process asphalt shingles is shown in FIG. 1. This figure illustrates sawtooth cutting heads 300 attached to the surface of the rotating drum 200. A number of cutting heads 300 are provided which are arranged axially and spaced circumferentially along the drum. Each cutting head 300 comprises a base 5 having a leading area 6 and a trailing area 7 (with reference to the direction of rotation R). A sawtooth cutting tool 43 is attached to the trailing area 7, while the leading area 6 acts as a raker. The raker 6 does not cut or grind but merely functions to gauge the depth at which the rear sawtooth cutting tool 43 cuts the material. For example, a cutting depth "x" is depicted in FIG. 1. During operation, the drum 200 rotates so that the leading area 6 of the cutting apparatus 300 travels ahead of the trailing area 7, thereby raking the material which is then cut by the sawtooth cutting tool 43. Thus, the shingle material is cut once each time it passes a cutting apparatus 300. As noted earlier, the process of raking and cutting with the sawtooth cutting apparatus 300 does eventually break down the asphalt shingles into a proper size, but not before friction creates excessive frictional heat.

The excessive heat is produced because the grinding apparatus inefficiently processes the extremely abrasive asphalt shingles. Most of the frictional heat is created when the raker of each head rubs against the shingles. Also, as the shingles must reach approximately one inch in diameter, they cycle around the inside of the screened container, thereby creating more friction. The shingles are cut and raked repeatedly until they are small enough to exit through the screen, thereby creating the excessive frictional heat that melts the shingles.

When the shingles melt inside the processing apparatus, the apparatus becomes bound and damages the drum-driving motor and the cutting heads. Also, the apparatus will not function again until the melted asphalt is removed, which is costly and time consuming. The available wood-grinders are too inefficient and create too much friction, thereby creating high temperatures that melt the asphalt shingles before the desired byproduct is produced.

The above noted problems are clearly evidenced by the fact that it was only commercially viable to use that apparatus to grind asphalt shingles in an extremely cold environment, such as the far northern hemisphere during winter, where extremely low temperatures prevented the shingles from melting during grinding. Thus, it would be desirable to develop a cutting apparatus and method for cutting asphalt shingles that produces the desired product while avoiding the inconveniences caused by melted shingles.

SUMMARY OF THE INVENTION

The present invention fills the aforementioned needs by providing a method and apparatus for efficiently cutting asphalt shingles, thereby efficiently producing the desired product without melting the asphalt shingles.

One embodiment of the present invention defines a cutting head adapted to be mounted on a rotating member for travel in a forward direction, comprising a base having a leading area and a trailing area, a cutting tool having a body attached to the front area, and first and second cutting teeth mounted to the body and extending substantially parallel to one another. An opening is disposed between the first and a second cutting teeth, the first and second cutting teeth defining a first and second cutting path, respectively. A rear cutter member is attached to a trailing area for travel in a third cutting path between the first and the second cutting path. The first and second cutting teeth include respective funneling surfaces that are angled inwardly toward the opening in a trailing direction for directing material cut by the teeth through the opening and into the third cutting path.

BRIEF DESCRIPTION OF THE DRAWING

Many advantages of the present invention will be apparent to those skilled in the art with a reading of the specification in conjunction with the attached drawings, wherein like reference numerals are applied to like elements and wherein.

DESCRIPTION OF PREFERRED EMBODIMENTS OF THE INVENTION

In the present invention, the prior art's raker has been replaced by a tool configured to cut the material being processed, and to funnel the cuttings into the path of a rear cutting tool trailing between and behind the teeth. Materials, such as asphalt shingles, can now be cut with less friction, thus minimizing any melting of the shingles.

Figure 1:
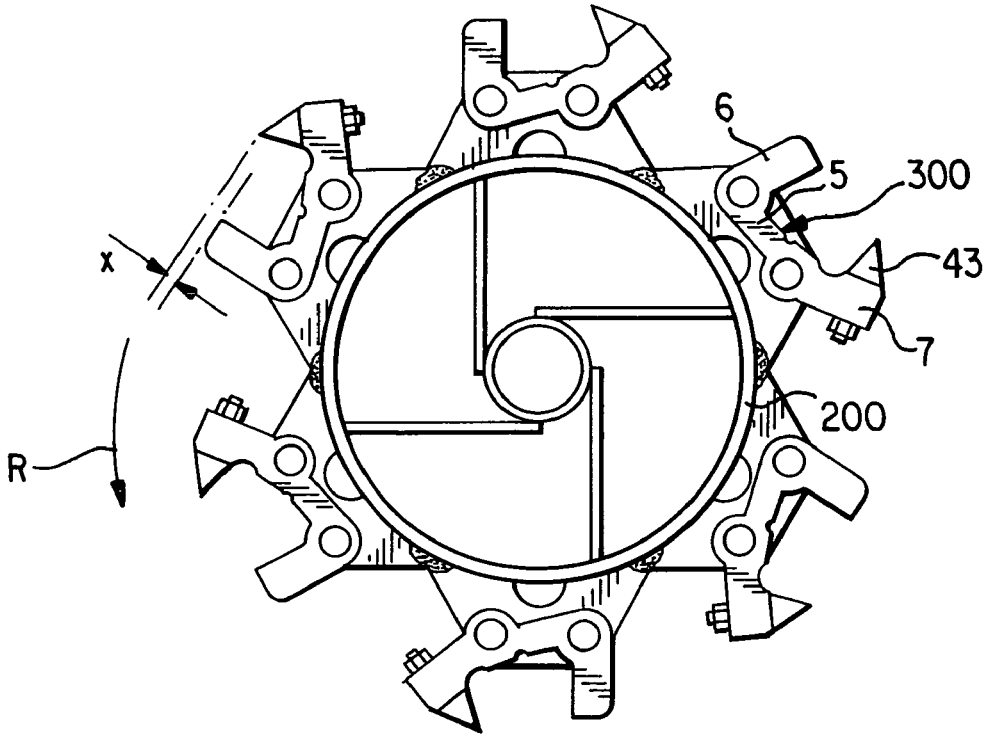
FIG. 1 (PRIOR ART)
FIG. 1 illustrates a side view of a prior art grinding apparatus.
Figure 2:
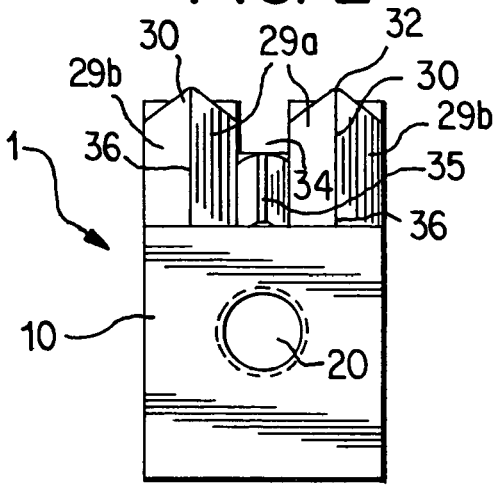
FIG. 2 illustrates a front view of a processor tool according to the invention having two cutting teeth extending from a base.
Figure 3:
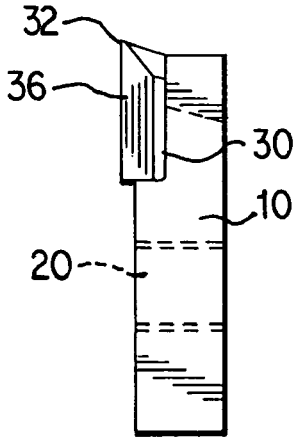
FIG. 3 illustrates a side view of the cutting tool of FIG. 2.
Figure 4:
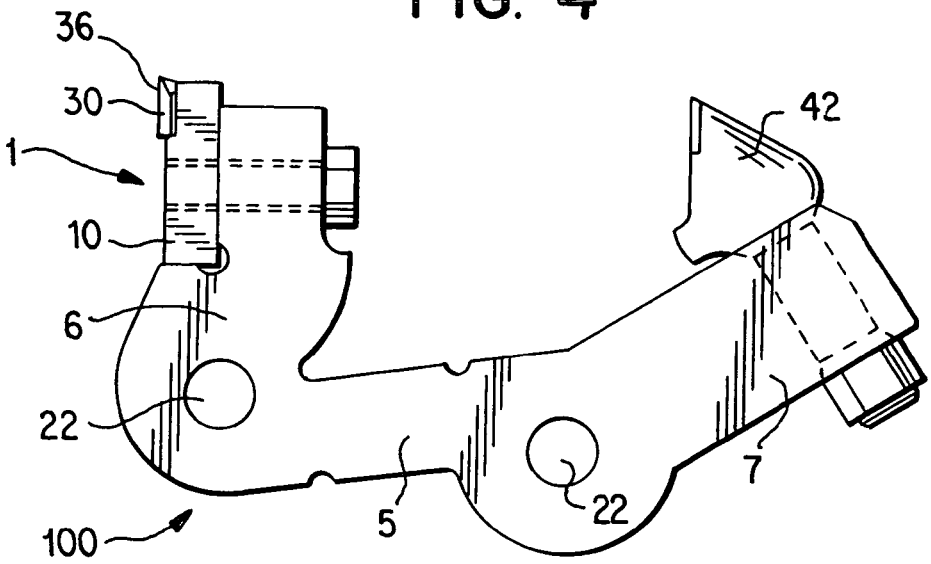
FIG. 4 illustrates a side view of the cutting tool attached to the front area of a body.
Figure 5:
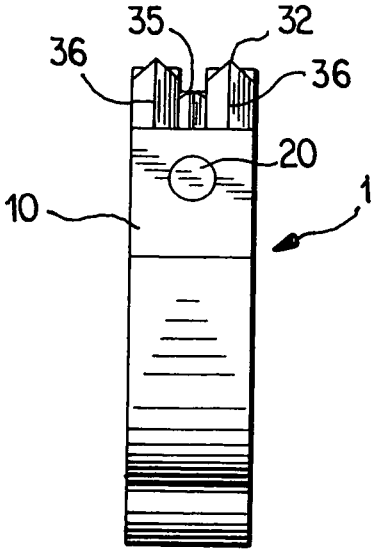
FIG. 5 illustrates a front view of the cutting tool attached to the front area of the body.

FIG. 2 illustrates a front view of one preferred embodiment of the cutting tool 1, as the tool 1 would be "seen" by an asphalt shingle being processed. The tool 1 would be attached to the base 5 of a cutting head 100 as shown in FIG. 4. A plurality of such cutting heads would be mounted on a drum, as shown in FIG. 1, e.g., in circumferentially and axially spaced relationships as is conventional. This embodiment of the cutting tool 1 includes a holder body 10 and two cutting teeth 30 extending from the body 10 substantially parallel to one another. The teeth 30 are preferably brazed in a notch formed in an edge of the body. Each tooth 30 comprises a pair of forwardly converging surfaces 29*a*, 29*b* that intersect to form a front cutting edge 36, and a point 32 located at the tip of each cutting tooth 30 (as used herein, "forwardly" is considered with reference to the direction of rotation R). A hole 20 is disposed in the body 10 for receiving a fastener to fasten the body 10 to the leading area of a base 5. It is preferred to fasten the body 10 with a screw 5*a*, but a bolt or other appropriate fastener may be used. An opening 34 is disposed between the two cutting teeth 30, and the surfaces 29*a*, 29*b* of the respective teeth 30 converge rearwardly toward the space, i.e. away from the cutting edges 36. The cutting teeth 30 are preferably made from carbide but may alternatively be made from other suitable materials.

Figure 6:
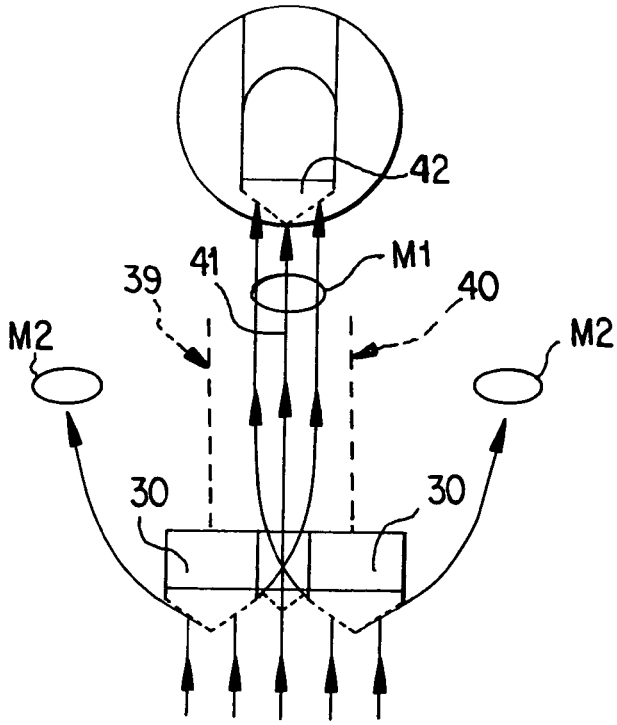
FIG. 6 illustrates a top view of a schematic depicting the path of shingle material as it is cut.

A wear bit 35 is mounted to the body 10 adjacent to the opening 34 and between the teeth 30. The bit 35 is preferably made from carbide and is brazed to the body 10, but can be made from other suitable materials. As the cutting tool 1 cuts shingles, this bit 35 contacts the shingles and gradually wears away thereby preventing the body 10 from wearing through to the hole 20 and compromising the attachment to the base 5. Preferably, the bit 35 will last long enough so that once it is worn away, the cutting teeth are also worn, thereby requiring replacement of the cutting tool. Now make reference to FIG. 4, which shows a cutting head that employs the cutting tool 1. The cutting head 100 comprises a base 5 having a leading area 6, a trailing area 7 and a hole 22 for receiving a fastener to fasten the cutting head to the rotating member, such as the drum 200 shown in FIG. 1. A cutting tool 1 is fastened to the leading area 6 of the base 5, and a rear cutting tool 42 is attached to the trailing area 7 of the base 5. Preferably the rear cutting tool is a sawtooth cutter type implement, but any suitable cutting tooth type implement may be used. During a shingle-processing operation, the cutting head 100 is rotated in a forward direction R on a drum (not shown) so that the leading cutting edges 36 of the cutting tool 1 impact and cut asphalt shingle material which is disposed in the path of the rotating cutting head 100. The surfaces 29*a*, 29*b* are angled so that a portion of the cut asphalt shingles is funneled into and through the space 34 located between the two cutting teeth 30 and between first and second cutting paths 39, 40 defined by the respective teeth 30. Thus, the surfaces 29*a*, 29*b* can be designated as funneling surfaces. That funneled shingle material M1 is then cut a second time by the rear cutting tool 42 which travels along a third cutting path 41 disposed between the first and second cutting paths 39, 40 (see FIG. 6). Thus, the three cutting paths 39, 40, 41 are spaced apart in a direction parallel to the drum's axis of rotation. Any shingle material M2 that is not funneled between the first and second cutting paths is instead directed along the surfaces 29*b* of the teeth and around the outside of the teeth 30 and thus outside of the first and second cutting paths 39, 40. This asphalt material M2 remains inside the outer screened container (not shown) and is repeatedly cut by other cutting heads 100, until its diameter is small enough to allow it to pass through the screened container.

The cutting action produced by the tool according to the present invention is unique and capable of cutting asphalt shingles more quickly, thereby generating less frictional heat that would otherwise tend to melt the shingles. Therefore, use of the invention avoids problems created in the prior art when asphalt shingles melt during cutting.

The above are exemplary modes of carrying out the invention and are not intended to be limiting. It will be apparent to those of ordinary skill in the art that modifications thereto can be made without departure from the spirit and scope of the invention as set forth in the accompanying claims.

What is claimed is:

1. A cutting head adapted to be mounted on a rotating member for travel in a forward direction, comprising:

a base having a leading area and a trailing area;

a cutting tool having a holder body, the holder body being attached to the leading area, and first and second cutting teeth mounted to the holder body and extending substantially parallel to one another, wherein an opening is disposed between the first and second cutting teeth, the first and second cutting teeth defining first and second cutting paths, respectively, and a rear cutting member attached to the trailing area for travel in a third cutting path between the first and second cutting paths;

the first and second cutting teeth including respective funneling surfaces converging inwardly toward the opening for directing material cut by the teeth through the opening and into the third cutting path, wherein the cutting teeth extend in a direction substantially perpendicular to the forward direction at least as far from the base as the rear cutting member.

2. The cutting head according to claim 1, further comprising a wear bit mounted on the holder body adjacent to the opening and between the teeth for minimizing wear of the holder body.

3. The cutting head according to claim 2, wherein the bit comprises carbide.

4. The cutting head according to claim 1, wherein each tooth comprises a cutting edge.

5. The cutting head according to claim 4, wherein the cutting edge is defined by an intersection of the funneling surface and an additional tooth surface arranged for directing cut material away from the opening.

6. The cutting head according to claim 1, wherein the cutting tool is attached with a fastening element, and is removable.

7. The cutting head according to claim 1, wherein the cutting teeth comprise metal.

8. The cutting head according to claim 1, wherein the cutting teeth comprise carbide.

9. A cutting tool adapted for attachment to the leading end of a base of a cutting head movable in a forward direction to impact asphalt shingles, a trailing end of the base including a rear cutting member, the cutting tool comprising:

a holder body;

first and second cutting teeth attached to the holder body and extending generally parallel to one another so that a space is disposed between the cutting teeth, the cutting teeth extending in a direction substantially perpendicular to the forward direction at least as far from the base as the rear cutting member when the cutting tool is attached to the base of the cutting head, the cutting teeth defining respective first and second cutting paths disposed on opposite sides of the space, each cutting tooth including a cutting edge and a funneling surface disposed adjacent to the cutting edge;

the first and second cutting teeth arranged wherein the respective funneling surfaces converge away from the cutting edges and toward the opening.

10. The cutting tooth according to claim 9, further comprising a wear bit mounted on the holder body adjacent to the opening and between the teeth for minimizing wear of the holder body.

11. The cutting tool according to claim 10, wherein the wear bit comprises carbide.

12. The cutting tool according to claim 9, wherein each cutting edge is defined by an intersection of the funneling surface with an additional tooth surface arranged for directing cut material away from the opening.

13. The cutting tool according to claim 9, wherein the cutting tooth comprises metal.

14. The cutting tool according to claim 9, wherein the cutting tooth comprises carbide.

* * * * *